US011637361B2

(12) United States Patent
Chen et al.

(10) Patent No.: US 11,637,361 B2
(45) Date of Patent: Apr. 25, 2023

(54) ANTENNA STRUCTURE AND WIRELESS COMMUNICATION DEVICE

(71) Applicant: Chiun Mai Communication Systems, Inc., New Taipei (TW)

(72) Inventors: Yung-Chin Chen, New Taipei (TW); Kun-Lin Sung, New Taipei (TW); Yi-Chieh Lee, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 318 days.

(21) Appl. No.: 17/106,347

(22) Filed: Nov. 30, 2020

(65) Prior Publication Data

US 2021/0218130 A1 Jul. 15, 2021

(30) Foreign Application Priority Data

Jan. 14, 2020 (CN) ..... 202010037127.6

(51) Int. Cl.

| | |
|---|---|
| ***H01Q 1/24*** | (2006.01) |
| ***H01Q 13/10*** | (2006.01) |
| ***H01Q 5/378*** | (2015.01) |
| ***H01Q 1/48*** | (2006.01) |

(52) U.S. Cl.

CPC ..... *H01Q 1/243* (2013.01); *H01Q 1/48* (2013.01); *H01Q 5/378* (2015.01); *H01Q 13/10* (2013.01)

(58) Field of Classification Search

CPC ..... H01Q 1/243; H01Q 1/48; H01Q 5/378; H01Q 13/10

See application file for complete search history.

(56) References Cited

U.S. PATENT DOCUMENTS

| | | | | |
|---|---|---|---|---|
| 2015/0372372 | A1* | 12/2015 | Lee | H01Q 1/243 343/702 |
| 2018/0026335 | A1* | 1/2018 | Lee | H01Q 1/242 343/702 |
| 2018/0026354 | A1* | 1/2018 | Lin | H01Q 5/335 343/702 |
| 2019/0181552 | A1* | 6/2019 | Lee | H01Q 3/247 |
| 2021/0126349 | A1* | 4/2021 | Zhou | H01Q 1/243 |

FOREIGN PATENT DOCUMENTS

| | | |
|---|---|---|
| CN | 205543232 U | 8/2016 |
| CN | 107645042 A | 1/2018 |
| CN | 110661082 A | 1/2020 |

* cited by examiner

*Primary Examiner* — Andrea Lindgren Baltzell
*Assistant Examiner* — Amal Patel
(74) *Attorney, Agent, or Firm* — ScienBiziP, P.C.

(57) ABSTRACT

An antenna structure includes a metal frame, a feeding portion, and a first ground portion. The metal frame is provided with a slot, a first gap, a second gap, and a third gap. The first gap, the second gap, and the third gap are coupled to the slot, and the slot, the first gap, the second gap, and the third gap divide the metal frame into a radiating portion and a first coupling portion. A portion of the metal frame between the first gap and the third gap form the radiating portion, and a portion of the metal frame between the second gap and the third gap form the first coupling portion. The feeding portion is electrically coupled to the radiating portion to feed an electric signal to the radiating portion. The first ground portion is electrically coupled to the radiating portion to provide ground to the radiating portion.

12 Claims, 7 Drawing Sheets

ANTENNA STRUCTURE AND WIRELESS COMMUNICATION DEVICE

FIELD

The subject matter herein generally relates to antenna structures, and more particularly to an antenna structure for a wireless communication device.

BACKGROUND

With the advancement of wireless communication technology, how to design an antenna with a wider bandwidth in a limited space is an important issue facing antenna design.

BRIEF DESCRIPTION OF THE DRAWINGS

Implementations of the present disclosure will now be described, by way of embodiments, with reference to the attached figures.

DETAILED DESCRIPTION

Figure 1:
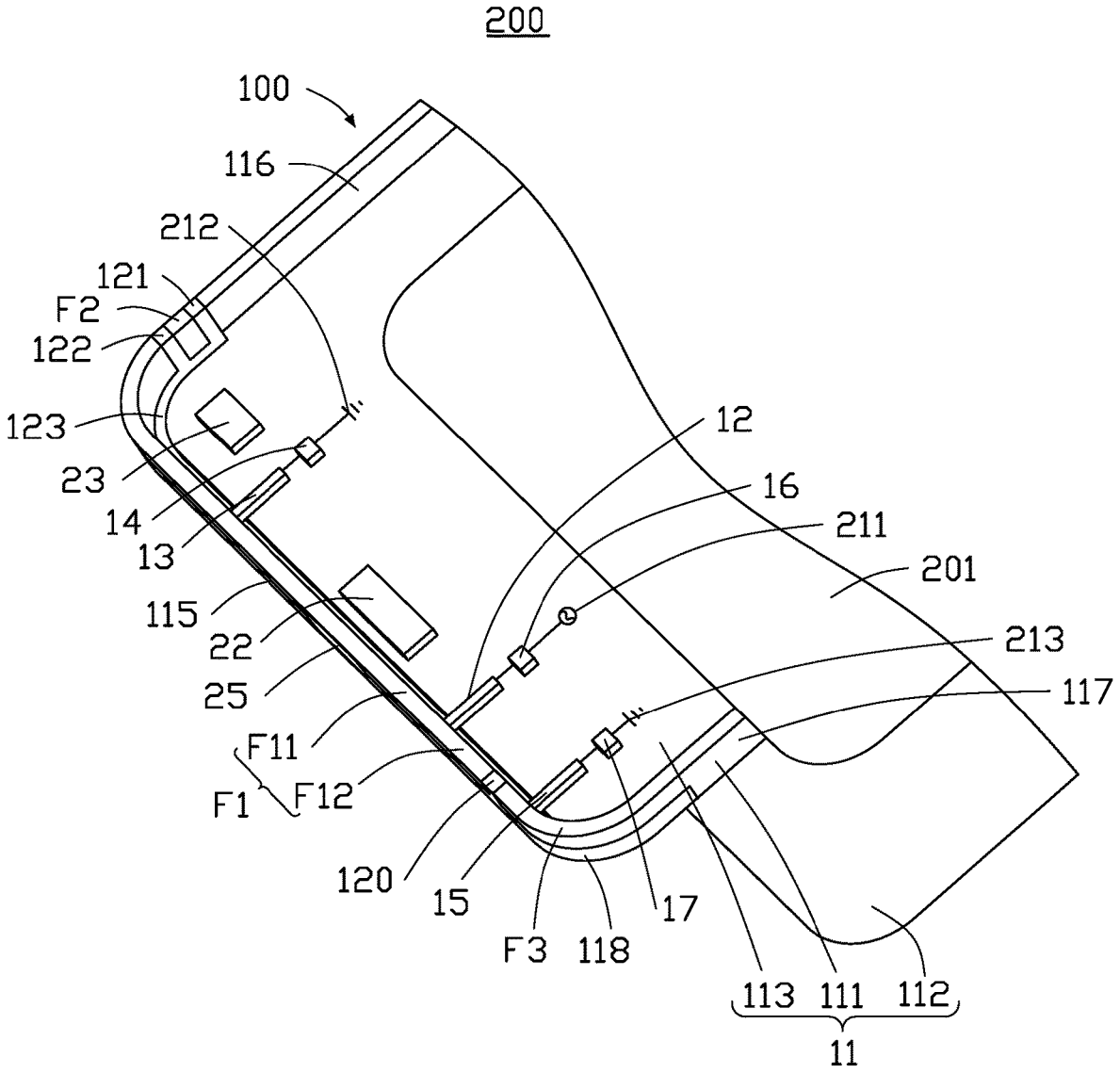
FIG. 1 is a schematic diagram of an embodiment of an antenna structure applied to a wireless communication device.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or another word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series, and the like.

Figure 2:
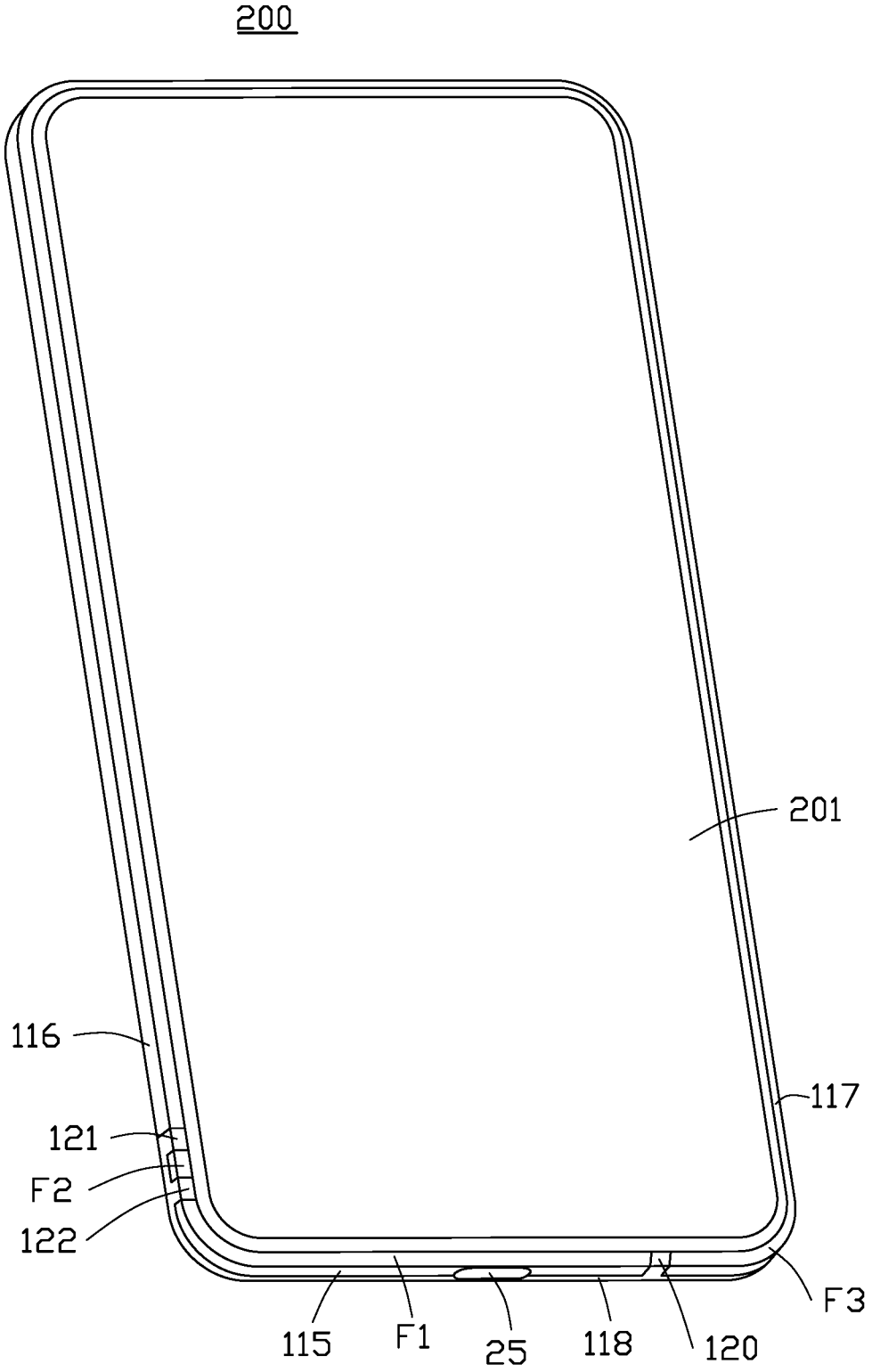
FIG. 2 is a perspective schematic diagram of the wireless communication device shown in FIG. 1.

FIGS. 1 and 2 show an embodiment of an antenna structure 100, which can be applied to a wireless communication device 200 such as a mobile phone, a personal digital assistant, or the like for transmitting and receiving radio waves for transmitting and exchanging wireless signals.

The antenna structure 100 includes a metal housing 11, a feeding portion 12, a first ground portion 13, a first switching circuit 14, a second ground portion 15, and a second switching circuit 17.

The metal housing 11 includes a metal frame 111, a metal backplane 112, and a metal middle frame 113. The metal frame 111 has a substantially annular structure and is made of metal or other conductive materials. The metal backplane 112 is made of metal or other conductive materials. The metal backplane 112 is arranged on an edge of the metal frame 111. An opening (not labeled) is provided on a side of the metal frame 111 away from the metal backplane 112 for accommodating a display unit 201 of the wireless communication device 200. It can be understood that the display unit 201 includes a display plane, and the display plane faces out of the opening.

The metal middle frame 113 is substantially rectangular and made of metal or other conductive materials. In one embodiment, the metal middle frame 113 is a metal sheet located between the display unit 201 and the metal backplane 112. The metal middle frame 113 is used to support the display unit 201, provide electromagnetic shielding, and improve a mechanical strength of the wireless communication device 200. It can be understood that the metal frame 111, the metal backplane 112, and the metal middle frame 113 may be an integrally formed metal structure.

In one embodiment, the display unit 201 has a high screen-to-body ratio. That is, an area of the display plane of the display unit 201 constitutes a full screen and is greater than 70% of a front area of the wireless communication device 200. Specifically, in one embodiment, in addition to necessary slots opened in the antenna structure 100, left, right, and lower sides of the display unit 201 can be seamlessly coupled to the metal frame 111.

In one embodiment, the metal frame 111 includes an end portion 115, a first side portion 116, and a second side portion 117. The end portion 115 is a bottom end of the wireless communication device 200, that is, the antenna structure 100 constitutes a lower antenna of the wireless communication device 200. The first side portion 116 and the second side portion 117 are arranged opposite each other and are respectively arranged at opposite ends of the end portion 115.

The metal housing 11 is provided with a slot 118 and at least one gap. The slot 118 is substantially U-shaped and defined in the end portion 115 of the metal frame 111 and extends toward the first side portion 116 and the second side portion 117. In one embodiment, the slot 118 is defined in the metal frame 111 at a position adjacent to the metal backplane 112 and extends toward a direction where the display unit 201 is located. In one embodiment, a width of the slot 118 is substantially half of a width of the metal frame 111. That is, the slot 118 is arranged on a side of the metal frame 111 adjacent to the metal backplane 112 and extends in a direction away from the metal backplane 112 toward a middle of the metal frame 111.

In one embodiment, the metal housing 11 is provided with a first gap 120, a second gap 121, and a third gap 122. The first gap 120, the second gap 121, and the third gap 122 are all defined in the metal frame 111. Specifically, the first gap 120 is defined in the end portion 115 adjacent to the second side portion 117. The second gap 121 and the first gap 120 are spaced apart. The second gap 121 is defined in the first side portion 116 adjacent to the end portion 115. The third gap 122 is defined between the first gap 120 and the second gap 121. Specifically, the third gap 122 is arranged on the first side 116 adjacent to the second gap 121. The first gap 120, the second gap 121, and the third gap 122 all penetrate and divide the metal frame 111 and are coupled to the slot 118.

In one embodiment, the slot 118, the first gap 120, the second gap 121, and the third gap 122 divide the metal housing 11 into a radiating portion F1, a first coupling portion F2, and a second coupling portion F3. In one embodiment, a portion of the metal frame 111 between the first gap 120 and the third gap 122 forms the radiating portion F1, a portion of the metal frame 111 between the second gap 121 and the third gap 122 forms the first coupling portion F2, and a portion of the metal frame 111 between the first gap 120 and an end point of the slot 118 located on the second side portion 117 forms the second coupling portion F3.

In one embodiment, a notch 123 is defined in a portion of the metal middle frame 113 adjacent to the end portion 115 and extending along an edge of the metal middle frame 113 along parallel portions of the first side portion 116 and the second side portion 117. The notch 123 extends substantially parallel to the slot 118 and communicates with the slot 118, the first gap 120, the second gap 121, and the third gap 122.

In one embodiment, the radiating portion F1 and the first coupling portion F2 are both spaced apart from and insulated from the metal middle frame 113. A side of the second coupling portion F3 adjacent to an end of the slot 118 on the second side portion 117 is coupled to the metal middle frame 113 and the metal backplane 112, that is, grounded. In one embodiment, the slot 118 and the notch 123 are used to separate a metal frame radiator (the radiating portion F1, the first coupling portion F2, and the second coupling portion F3) from the metal backplane 112.

In one embodiment, widths of the first gap 120, the second gap 121, and the third gap 122 are the same. In one embodiment, the widths of the first gap 120, the second gap 121, and the third gap 122 are all 1-2 mm.

In one embodiment, the slot 118, the first gap 120, the second gap 121, the third gap 122, and the notch 123 are all filled with insulating materials, such as plastic, rubber, glass, wood, ceramics, or the like.

Figure 3:
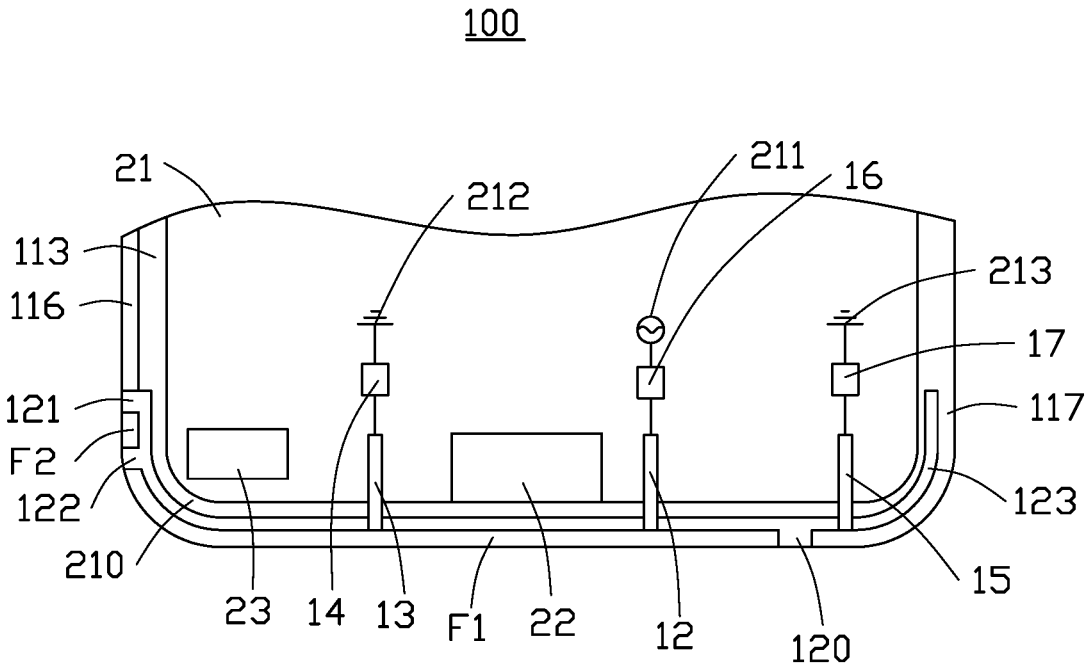
FIG. 3 is a circuit diagram of the antenna structure shown in FIG. 1.

Referring to FIG. 3, the wireless communication device 200 further includes a circuit board 21 and at least one electronic component. The circuit board 21 is arranged in a space enclosed by the metal frame 111, the metal backplane 112, and the metal middle frame 113. One end of the circuit board 21 is spaced from the metal frame 111, and a corresponding clearance area 210 is defined between the circuit board 21 and the metal frame 111. In one embodiment, a size of the clearance area 210 is substantially 1-3 mm. The circuit board 21 is further provided with a feed point 211, a first ground point 212, and a second ground point 213. The feed point 211, the first ground point 212, and the second ground point 213 are spaced apart from each other. The feed point 211 is used to provide a feed signal for the antenna structure 100. The first ground point 212 and the second ground point 213 are used to ground the antenna structure 100.

In one embodiment, the wireless communication device 200 includes at least two electronic components, namely a first electronic component 22 and a second electronic component 23. The first electronic component 22 and the second electronic component 23 are both arranged on a same side of the circuit board 21 adjacent to the end portion 115. In one embodiment, the first electronic component 22 is a universal serial bus (USB) interface module. The first electronic component 22 is arranged in a middle of the circuit board 21 adjacent to the end portion 115 and is insulated from the radiating portion F1. The second electronic component 23 is a speaker. The second electronic component 23 is arranged between the first electronic component 22 and the first side portion 116. In one embodiment, the second electronic component 23 is also spaced apart and insulated from the radiating portion F1, and a distance from the second electronic component 23 to the radiating portion F1 is greater than a distance from the first electronic component 22 to the radiating portion F1.

In other embodiments, positions of the first electronic component 22 and the second electronic component 23 can be adjusted according to specific requirements.

In one embodiment, a port 25 is provided on the metal frame 111. The port 25 is provided in a middle of the end portion 115 and penetrates the end portion 115. The port 25 corresponds to the first electronic component 22 so that a USB device can be inserted through the port 25 to establish an electrical connection with the first electronic component 22.

In one embodiment, the feeding portion 12 is arranged in the metal housing 11. One end of the feeding portion 12 can be electrically coupled to a side of the radiating portion F1 adjacent to the first gap 120 by means of elastic sheets, microstrip lines, strip lines, coaxial cables, or the like, and another end of the feeding portion 12 is electrically coupled to the feed point 211 through a matching circuit 16 for feeding a current signal to the radiating portion F1.

In one embodiment, the feeding portion 12 may be made of iron, copper foil, or other conductive materials formed by a laser direct structuring (LDS) process.

In one embodiment, the matching circuit 16 may be an L-type matching circuit, a T-type matching circuit, a it-type matching circuit, or other capacitors, inductors, or combination of capacitors and inductors to adjust impedance matching of the radiating portion F1.

In one embodiment, the feeding portion 12 is further used to divide the radiating portion F1 into a first radiating section F11 and a second radiating section F12. A portion of the metal frame 111 between the feeding portion 12 and the third gap 122 forms the first radiating section F11, and a portion of the metal frame 111 between the feeding portion 12 and the first gap 120 forms the second radiating section F12.

In one embodiment, a position of the feeding portion 12 does not correspond to a middle of the radiating portion F1, so a length of the first radiating section F11 is longer than a length of the second radiating section F12.

In one embodiment, the first ground portion 13 is arranged in the metal housing 11 and located between the first electronic component 22 and the second electronic component 23. One end of the first ground portion 13 is electrically coupled to the radiating portion F1, and another end of the first ground portion 13 is electrically coupled to the first ground point 212 through the first switching circuit 14 to provide ground for the radiating portion F1.

The second ground portion 15 is arranged in the metal housing 11 and located between the first gap 120 and the second side portion 117. One end of the second ground portion 15 is electrically coupled to the second coupling portion F3, and another end of the second ground portion 15 is electrically coupled to the second ground point 213 through the second switching circuit 17, thereby providing ground for the second coupling portion F3.

Figure 4:
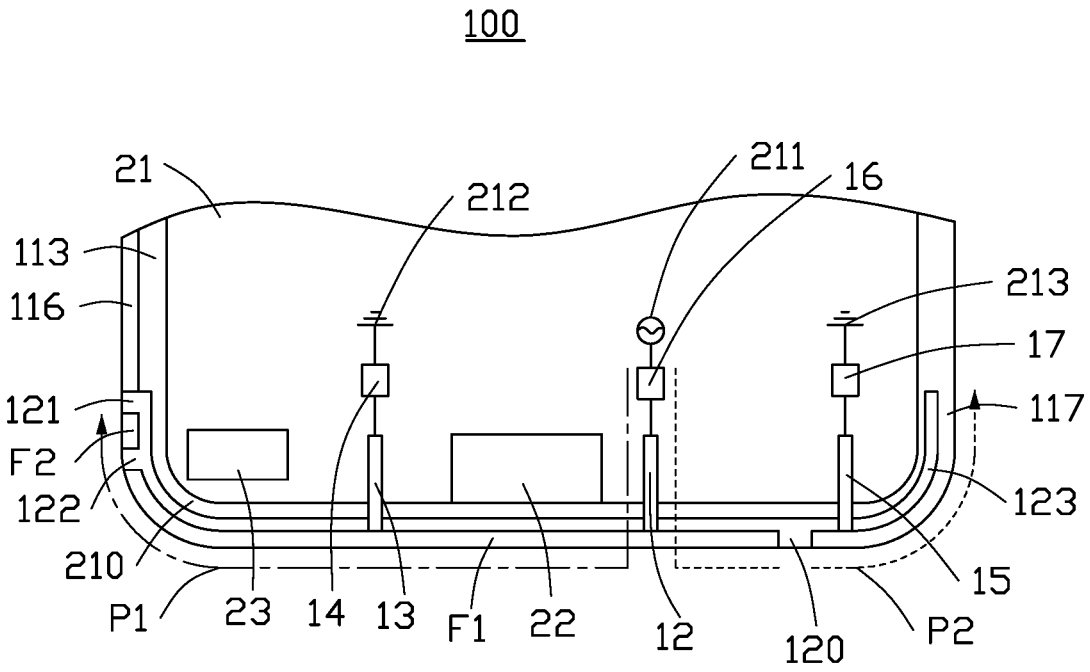
FIG. 4 is a schematic diagram of an electric current flow of the antenna structure shown in FIG. 3.

FIG. 4 shows a current path diagram of the antenna structure 100. When the feeding portion 12 feeds an electric current, the electric current flows through the first radiating section F11 of the radiating portion F1 toward the third gap 122, and then is coupled to the first coupling portion F2 through the third gap 122 (reference path P1) and excites a first operating mode to generate a radiation signal in a first radiation frequency band.

After the feeding portion 12 feeds the electric current, the electric current also flows through the second radiating section F12 of the radiating portion F1, and then is coupled to the second coupling portion F3 through the first gap 120, and finally flows to the second ground point 213 through the second switching circuit 17 (reference path P2) and excites a second operating mode to generate a radiation signal in a second radiation frequency band.

In one embodiment, the first operating mode includes a Long Term Evolution Advanced (LTE-A) low frequency mode and intermediate frequency mode, and the second operating mode includes an LTE-A high frequency mode. Frequencies of the first radiation band are 700-960 MHz and 1710-2170 MHz. Frequencies of the second radiation frequency band are 2300-2690 MHz. The low frequency portion of the first radiation frequency band is mainly excited by the first coupling portion F2. The intermediate frequency portion of the first radiation frequency band is mainly excited by the radiating portion F1.

Figure 5:
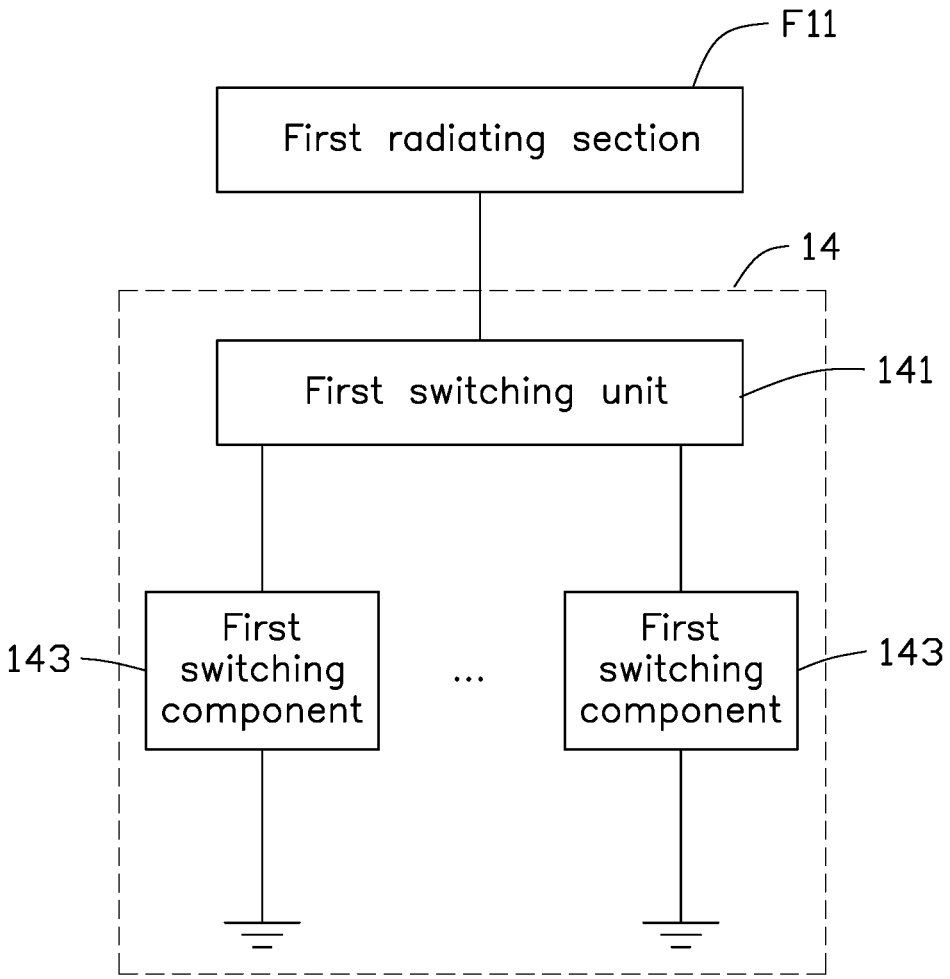
FIG. 5 is a circuit diagram of a first switching circuit of the antenna structure shown in FIG. 3.

Referring to FIG. 5, in one embodiment, the first switching circuit 14 includes a first switching unit 141 and at least one first switching component 143. The first switching unit 141 may be a single pole single throw switch, a single pole double throw switch, a single pole three throw switch, a single pole four throw switch, a single pole six throw switch, a single pole eight throw switch, or the like. The first switching unit 141 is electrically coupled to the first radiating section F11. The first switching component 143 may be an inductor, a capacitor, or a combination of an inductor and a capacitor. The first switching components 143 are coupled in parallel to each other, and one end of each first switching component 143 is electrically coupled to the first switching unit 141, and another end of each first switching component 143 is electrically coupled to the first ground point 212. In this way, by controlling the first switching unit 141 to switch the first radiating section F11 to couple to different first switching components 143, the first radiating section F11 can be switched to adjust the low frequency band in the first radiating frequency band.

In one embodiment, a circuit structure and working principle of the second switching circuit 17 are similar to those of the first switching circuit 14, except that the second switching circuit 17 is used to adjust the second radiation frequency band. The second switching circuit 17 will not be described herein.

Figure 6:
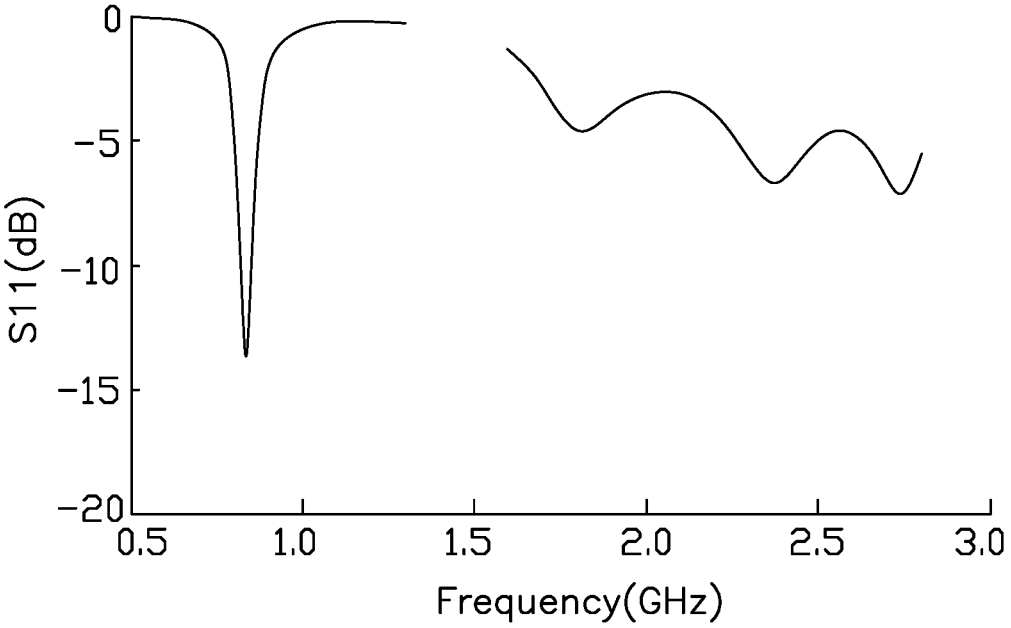
FIG. 6 is a graph of scattering parameters of the antenna structure shown in FIG. 4.

FIG. 6 is a graph of scattering parameters (S parameters) of the antenna structure 100.

Figure 7:
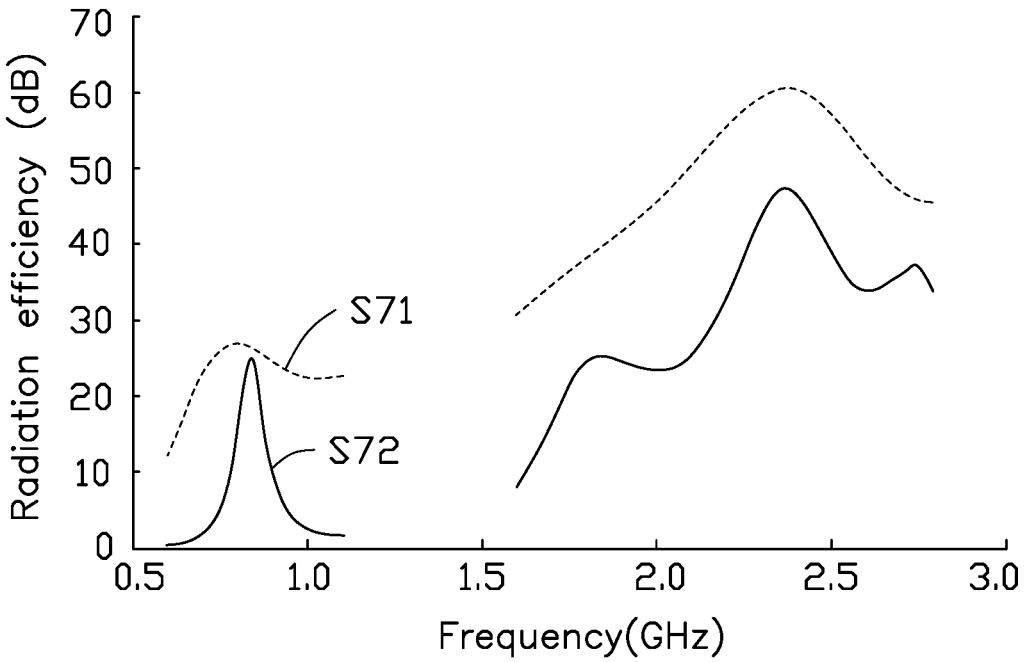
FIG. 7 is a radiation efficiency diagram of the antenna structure shown in FIG. 4.

FIG. 7 is a graph of radiation efficiency of the antenna structure 100. A curve S71 is a radiation efficiency of the antenna structure 100. A curve S72 is a total radiation efficiency of the antenna structure 100.

In summary, the antenna structure 100 provides the first gap 120, the second gap 121, and the third gap 122 to form the radiating portion F1, the first coupling portion F2, and the second coupling portion F3. The antenna structure 100 further includes the first switching circuit 14 and the second switching circuit 17. In this way, the LTE-A low-frequency band, the LTE-A intermediate frequency band, and the LTE-A high-frequency band can be covered by different switching methods, which causes the radiation of the antenna structure 100 to have a wider frequency effect than that of a general metal back cover antenna. Furthermore, the antenna structure 100 has a front full screen, and the antenna structure 100 still has good performance in an all-metal metal backplane 112 and metal frame 111. It can be understood that in other embodiments, the positions of the first gap 120, the second gap 121, and the third gap 122 can be adjusted according to specific conditions. For example, the first gap 120 may be located at a position of the end portion 115 adjacent to the first side portion 116, and the second gap 121 and the third gap 122 may be arranged on the second side portion 117 at intervals. Correspondingly, the components in the metal housing 11, such as the feeding portion 12, the first ground portion 13, the second ground portion 15, the first switching circuit 14, the second switching circuit 17, and the like are located according to the positions of the above-mentioned gaps.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure applied to a wireless communication device comprising a display unit, the antenna structure comprising:

a metal housing comprising a metal frame and a metal backplane, the metal frame arranged around an edge of the metal backplane and provided with a slot, a first gap, a second gap, and a third gap, the first gap, the second gap, and the third gap coupled to the slot, and the slot, the first gap, the second gap, and the third gap dividing the metal frame into a radiating portion and a first coupling portion, a portion of the metal frame between the first gap and the third gap forming the radiating portion, and a portion of the metal frame between the second gap and the third gap forming the first coupling portion; the metal frame comprising an end portion, a first side portion, and a second side portion, the first side portion and the second side portion respectively coupled at opposite ends of the end portion, the slot defined in the end portion and extending in the direction of the first side portion and the second side portion, the first gap defined in the end portion and located adjacent to the second side portion, the second gap defined in the first side portion and located adjacent to the end portion, the third gap defined between the first gap and the second gap, a portion of the metal frame between the first gap and an end point of the slot located on the second side portion forming a second coupling portion;

a feeding portion electrically coupled to the radiating portion to feed an electric signal to the radiating portion;

a first ground portion electrically coupled to the radiating portion to provide ground to the radiating portion; and a second ground portion, one end of the second ground portion electrically coupled to the second coupling portion, and another end of the second ground portion grounded;

wherein when the feeding portion feeds an electric current, the electric current flows through the radiating portion toward the third gap, and then is coupled to the first coupling portion through the third gap and excites a first operating mode to generate a radiation signal in a first radiation frequency band;

when the feeding portion feeds the electric current, the electric current flows through the radiating portion, and then is coupled to the second coupling portion through the first gap, and then is grounded through the second ground portion and excites a second operating mode to generate a radiation signal in a second radiation frequency band; and a frequency of the first radiation frequency band is lower than a frequency of the second radiation frequency band.

2. The antenna structure of claim 1, wherein:

the first operating mode includes a LTE-A low frequency mode and a LTE-A intermediate frequency mode;

the second operating mode includes a LTE-A high frequency mode;

a low frequency portion of the first radiation frequency band is excited by the radiating portion; and an intermediate frequency portion of the first radiation frequency band is excited by the first coupling portion.

3. The antenna structure of claim 2, further comprising a first switching circuit and a second switching circuit, wherein:

one end of the first switching circuit is electrically coupled to the first ground portion, and another end of the first switching circuit is grounded for adjusting a frequency of the first radiation frequency band;

one end of the second switching circuit is electrically coupled to the second ground portion, and another end of the second switching circuit is grounded for adjusting a frequency of the second radiation frequency band.

4. The antenna structure of claim 1, wherein:

the slot is defined in the metal frame at a position adjacent to the metal backplane and extends toward the display unit; and a width of the slot is half a width of the metal frame.

5. The antenna structure of claim 1, further comprising a metal middle frame, wherein:

the metal middle frame is arranged in the metal housing;

a notch is defined in a portion of the metal middle frame adjacent to the end portion; and the notch communicates with the slot.

6. The antenna structure of claim 5, further comprising a circuit board, wherein:

the circuit board is arranged in a space enclosed by the metal frame, the metal backplane, and the metal middle frame;

one end of the circuit board is spaced apart from the metal frame, thereby defining a clearance area between the circuit board and the metal frame; and the clearance area has a size of 1-3 mm.

7. A wireless communication device comprising:

a display unit; and an antenna structure comprising:

a metal housing comprising a metal frame and a metal backplane, the metal frame arranged around an edge of the metal backplane and provided with a slot, a first gap, a second gap, and a third gap, the first gap, the second gap, and the third gap coupled to the slot, and the slot, the first gap, the second gap, and the third gap divide the metal frame into a radiating portion and a first coupling portion, a portion of the metal frame between the first gap and the third gap forming the radiating portion, and a portion of the metal frame between the second gap and the third gap forming the first coupling portion; the metal frame comprising an end portion, a first side portion, and a second side portion, the first side portion and the second side portion respectively coupled at opposite ends of the end portion, the slot defined in the end portion and extending in the direction of the first side portion and the second side portion, the first gap defined in the end portion and located adjacent to the second side portion, the second gap defined in the first side portion and located adjacent to the end portion, the third gap defined between the first gap and the second gap, a portion of the metal frame between the first gap and an end point of the slot located on the second side portion forming a second coupling portion;

a feeding portion electrically coupled to the radiating portion to feed an electric signal to the radiating portion;

a first ground portion electrically coupled to the radiating portion to provide ground to the radiating portion; and a second ground portion, one end of the second ground portion electrically coupled to the second coupling portion, and another end of the second ground portion grounded;

wherein when the feeding portion feeds an electric current, the electric current flows through the radiating portion toward the third gap, and then is coupled to the first coupling portion through the third gap and excites a first operating mode to generate a radiation signal in a first radiation frequency band;

when the feeding portion feeds the electric current, the electric current flows through the radiating portion, and then is coupled to the second coupling portion through the first gap, and then is grounded through the second ground portion and excites a second operating mode to generate a radiation signal in a second radiation frequency band; and a frequency of the first radiation frequency band is lower than a frequency of the second radiation frequency band.

8. The wireless communication device of claim 7, wherein:

the antenna structure further comprises a metal middle frame;

the metal middle frame is arranged in the metal housing;

a notch is defined in a portion of the metal middle frame adjacent to the end portion; and the notch communicates with the slot.

9. The wireless communication device of claim 8, further comprising a circuit board, wherein:

the circuit board is arranged in a space enclosed by the metal frame, the metal backplane, and the metal middle frame;

one end of the circuit board is spaced apart from the metal frame, thereby defining a clearance area between the circuit board and the metal frame; and the clearance area has a size of 1-3 mm.

10. The wireless communication device of claim 9, wherein:

the first operating mode includes a LTE-A low frequency mode and a LTE-A intermediate frequency mode;

the second operating mode includes a LTE-A high frequency mode;

a low frequency portion of the first radiation frequency band is excited by the radiating portion; and an intermediate frequency portion of the first radiation frequency band is excited by the first coupling portion.

11. The wireless communication device of claim 10, further comprising a first switching circuit and a second switching circuit, wherein:

one end of the first switching circuit is electrically coupled to the first ground portion, and another end of the first switching circuit is grounded for adjusting a frequency of the first radiation frequency band;

one end of the second switching circuit is electrically coupled to the second ground portion, and another end of the second switching circuit is grounded for adjusting a frequency of the second radiation frequency band.

12. The wireless communication device of claim 9, wherein:

the slot is defined in the metal frame at a position adjacent to the metal backplane and extends toward the display unit; and a width of the slot is half a width of the metal frame.

* * * * *